United States Patent [19]

Jaggi et al.

[11] 4,050,356

[45] Sept. 27, 1977

[54] APPARATUS FOR CONTROLLING A FLUID MEDIUM

[75] Inventors: Hans Jaggi, Wolfhausen; Hans Heimgartner, Jona, both of Switzerland

[73] Assignee: Haeny & Cie AG, Meilen, Switzerland

[21] Appl. No.: 556,395

[22] Filed: Mar. 7, 1975

[30] Foreign Application Priority Data

Mar. 11, 1974 Switzerland ..... 3345/74

[51] Int. Cl.[2] ..... F01L 25/06

[52] U.S. Cl. ..... 91/306; 91/313

[58] Field of Search ..... 91/313, 306

[56] References Cited

U.S. PATENT DOCUMENTS

| | | | |
|---|---|---|---|
| 2,296,647 | 9/1942 | McCormick | 91/313 |
| 3,090,364 | 5/1963 | Lefevre | 91/313 |
| 3,348,803 | 10/1967 | Churchill, Jr. | 91/313 |
| 3,540,349 | 11/1970 | Pennther | 91/313 |
| 3,555,966 | 1/1971 | Coniglio | 91/306 |
| 3,563,273 | 2/1971 | Mills | 91/313 |
| 3,604,310 | 9/1971 | Foster | 91/306 |

*Primary Examiner*—Paul E. Maslousky
*Attorney, Agent, or Firm*—Werner W. Kleeman

[57] ABSTRACT

An apparatus for the control of a fluid medium incorporating a fluid medium actuated switching element which can be reversed between two switching positions by means of two actuation elements working in the opposite sense. The actuation line or conduit of each actuation element is controlled by a normally closed shutoff valve, each actuation element is connected at its actuation line between the shutoff valve and a throttle location.

7 Claims, 4 Drawing Figures

1
2
3
3a
4
5
6
6a
7
8
9
10
11
12
13
14
15
16
17
18
19
20
21
22
23
24
25
26
27
A
P1
P2

8
90
7
10
12
140
P2
120
6a
6
5
7
6a
P1
110
130
4
11
22
180
21
170
2
24
26
25
27
23
1
3a
3

APPARATUS FOR CONTROLLING A FLUID MEDIUM

BACKGROUND OF THE INVENTION

The present invention relates to a new and improved construction of apparatus for the control of a fluid medium and which apparatus is of the type comprising a fluid medium actuated switching element which can be switched or reversed between two switching positions by means of two actuation elements acting in the opposite sense.

SUMMARY OF THE INVENTION

It is a primary object of the present invention to provide an improved construction of apparatus for the control of a fluid medium which is relatively simple in construction and design, extremely reliable in operation, not readily subject to breakdown and requires a minimum of maintenance and servicing.

A further object of the invention aims at the provision of apparatus for the control of a fluid medium for the purpose of selectively moving a switching element between two terminal positions in a highly reliable and positive manner.

Now in order to implement these and still further objects of the invention, which will become more readily apparent as the description proceeds, the apparatus of this development is manifested by the features that the actuation conduit or line of each actuation element is controlled by a normally closed shutoff valve, and wherein each actuation element is connected at its actuation conduit or line between the shutoff valve and a throttle location.

Preferably for such apparatus there is provided a reciprocating drive which can be reversed or switched by means of the switching element, and wherein according to the invention there is provided as the switching element a valve arrangement which in its switching positions in each instance controls the inflow and the outflow, respectively, of a pressurized fluid medium to and from respectively, the one or other side of a double-acting reciprocating piston. Moreover, the shutoff valves at the region of the terminal positions of the stroke of the reciprocating piston are actuated in the opening sense directly or indirectly by means of the reciprocating piston. In the context of this disclosure it is to be specifically understood that the expression "double-acting reciprocating piston" is employed in its broadest sense such that the same should include for instance lengthwise displaceable pistons or rotating pistons, also an arrangement in which two single pistons however acting in opposed relationship to one another functionally form a double-acting reciprocating piston.

Exemplary embodiments of the invention will be discussed more fully hereinafter in conjunction with the reversal of a reciprocating drive actuated by means of a pressurized fluid medium, and it being assumed that, by way of example, one is concerned with an hydraulic reciprocating drive.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
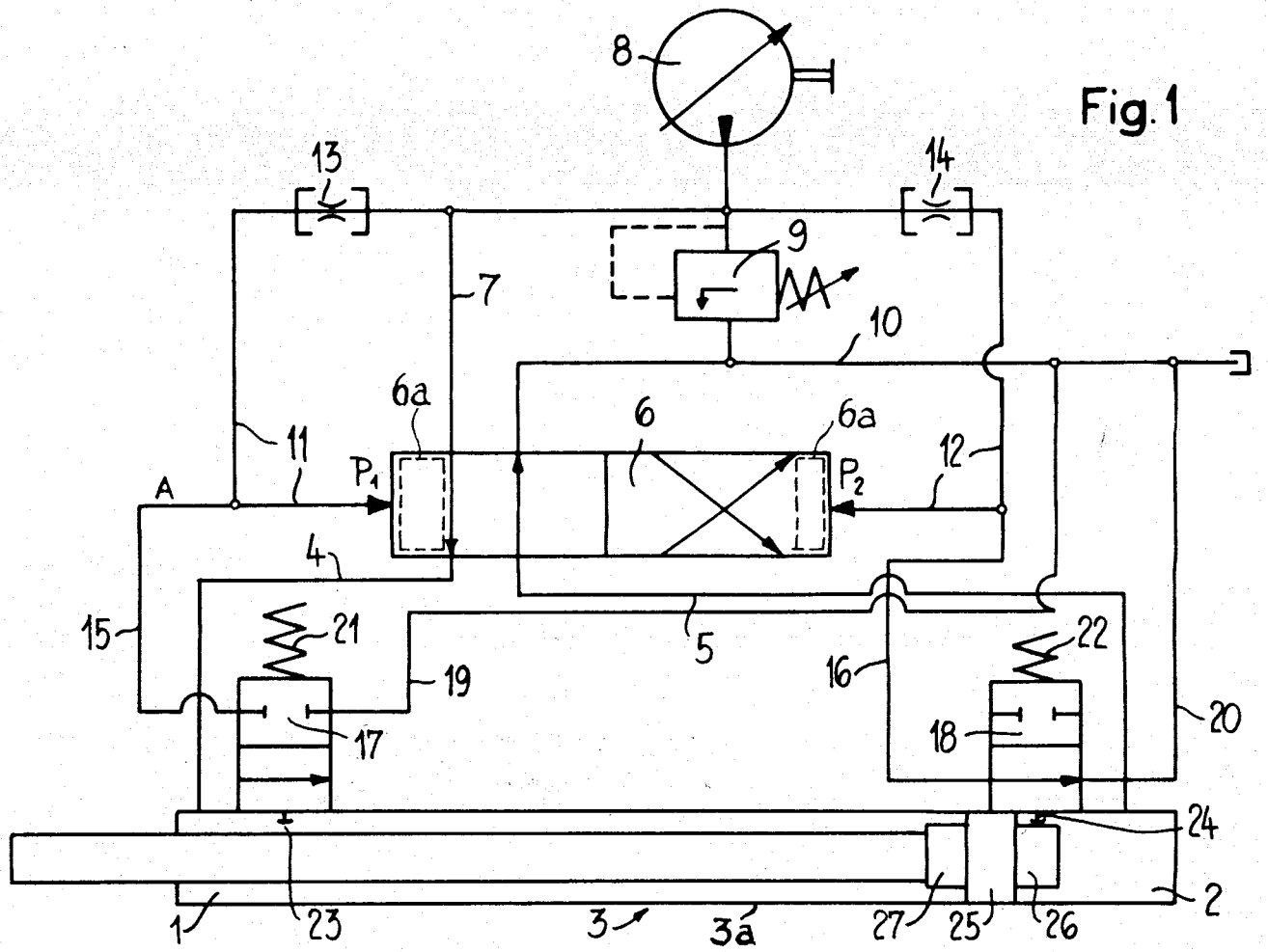
FIG. 1 illustrates a circuit diagram of apparatus for the control of a fluid medium as contemplated by the invention, there being employed in such diagram symbols conventionally used in the hydraulics art.

Describing now the drawings, in the arrangement of FIG. 1 both of the cylinder compartments or chambers 1 and 2 of a double-acting piston and cylinder arrangement 3 are connected by means of the conduits or lines 4 and 5, respectively, through the agency of a 2/2 displacement valve or valve unit 6 and its infeed line or conduit 7 with a motor driven pressure oil pump 8. The infeed line or conduit 7 is connected in a conventional manner through the agency of a pressure regulating valve 9 with a return flow line or conduit 10 of the displacement valve 6. As indicated by the arrows $P_1$ and $P_2$ the actuation lines or conduits 11 and 12 conduct the actuation fluid medium from the infeed line 7 to two actuation or servopistons, schematically indicated by reference characters 6*a* in FIG. 1, of the displacement or actuation valve 6 and which servopistons 6*a* act in the opposite sense and by means of which the displacement valve unit 6 can be reversed from the one into the other switching position. In this regard — and as such has been indicated by the symbols — the cylinder compartments 1 and 2 are alternately connected in the opposite sense with the infeed line 7 and the return flow line 10 respectively and vice versa. In the showing of FIG. 1 the cylinder compartment or chamber 1 is still just connected with the infeed line 7.

The actuation lines or conduits 11 and 12 receive the actuation fluid medium from the pump 8 in each case via a throttle location or throttle element 13 and 14 respectively. At the connection between the throttle locations 13 or 14 respectively with the actuation elements 6*a* of the displacement valve 6 i.e., at the actuation conduits 11 and 12 respectively, there is connected by means of a conduit 15 and 16, respectively, a respective shutoff valve, functionally considered an outlet valve 17 and 18 respectively. These valves 17 and 18 control the actuation lines or conduits 11 and 12, respectively, in that they connect the same — when opened — via the conduits 19 and 20, respectively, with the return flow line or conduit 10. The outlet or discharge valves 17 and 18, respectively, are subjected to the action of a respective valve spring 21 and 22 and constitute self-closing valves which, as will be demonstrated more fully in conjunction with the description of FIGS. 2 and 3, in each instance can be opened by means of a plunger 23 and 24 respectively.

The plungers 23 and 24 laterally protrude into the cylinder 3*a*, whereby they — in accordance with the arrangement of the outlet or shutoff valves 17 and 18 — at the region of the terminal positions of the stroke of the double-acting piston 25 cooperate with control surfaces 26 and 27 arranged at the end faces of such piston. As best seen by referring to FIGS. 2 and 3, the arrangement is designed such that the control surfaces 26 and 27 displace the corresponding plungers 24 and 23, respectively, in order to open the outlet valves 18 and 17 respectively. This is true in the showing of FIG. 1 with respect to the outlet or discharge valve 18 which connects the actuation conduit or line 12 with the conduit or line 20 and thus with the return flow line 10. On the other hand, in this working or operating phase the outlet valve 17 is closed.

Upon opening the outlet valve 18 and owing to appropriate dimensioning of the throttle location 14 there prevails a pressure drop in the actuation line or conduit 12, whereas, owing to the fact that the outlet valve 17 is closed, there is maintained the working or operating pressure in the actuation line or conduit 11. The displacement valve 6 under these circumstances is only impinged at one face or side, namely in the sense of the arrow $P_1$. Consequently, it is shifted into its second switching position. From the infeed line 7 the pressurized fluid medium (here possessing the properties of the working fluid medium) then arrives through the conduit 5 into the cylinder compartment or chamber 2 and initiates the "outward stroke" or ejection of the piston 25 and which stroke is directed towards the left of the showing of FIG. 1. The throttle location 14 in this regard insures that there will be available the required working or operating pressure until the outlet valve 18 is closed immediately after the beginning of such stroke, namely when the control surface 26 frees the plunger 24.

By appropriately designing the installation there is here available, on the other hand, the possibility, with the aid of the throttle location to bring about a gentle starting-up or initiation of the movement of the piston 25. As soon as the valve 18 is closed there occurs a build-up of pressure in the conduit 12 and the displacement valve 6 is once again hydraulically balanced-out. This condition lasts until the control surface 27 impacts against the other plunger 23 and the valve 17 now opens. The already described reversing or switching operation here occurs with reversed sign or sense. It is possible to attain any desired damping by suitable measures, such as for instance by throttling the oil infeed prior to the switching or reversal or by installing accumulators. Particularly advantageous is the fact that the outlet valves 17 and 18 possess plungers 23 and 24 which laterally protrude into the cylinder 3*a* (instead of for instance plungers extending in the direction of movement of the piston), so that by appropriate construction of the control surfaces 26 and 27 and the plungers 23 and 24 — apart from the damping — there can be maintained the terminal position with large tolerances.

Figure 2:
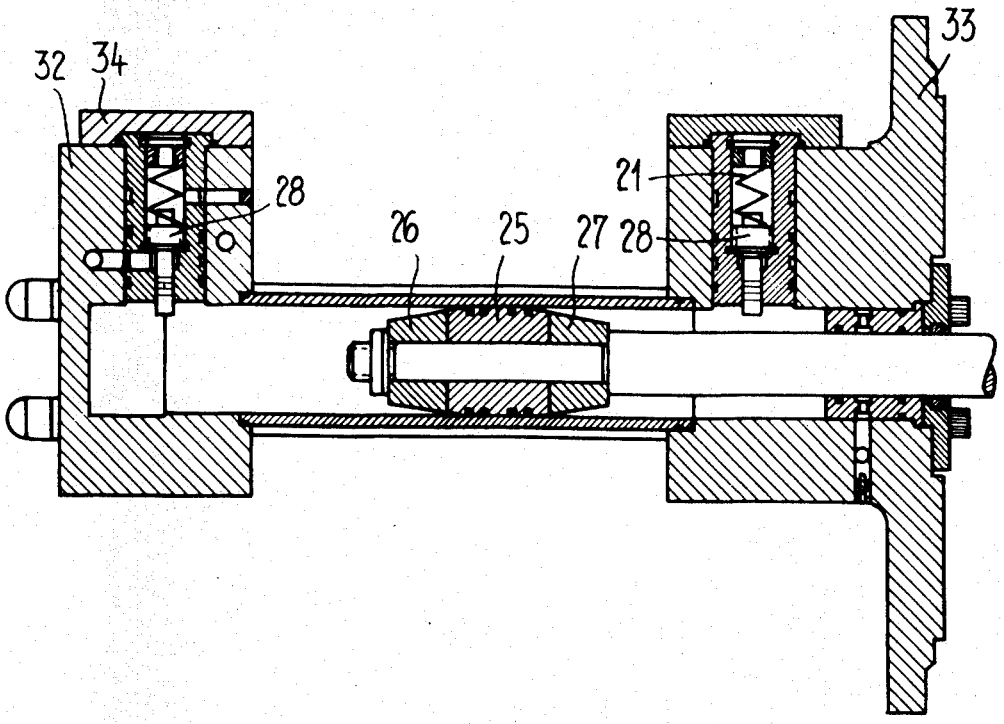
FIG. 2 is a longitudinal sectional view through a hydraulic reciprocating cylinder arrangement.
Figure 3:
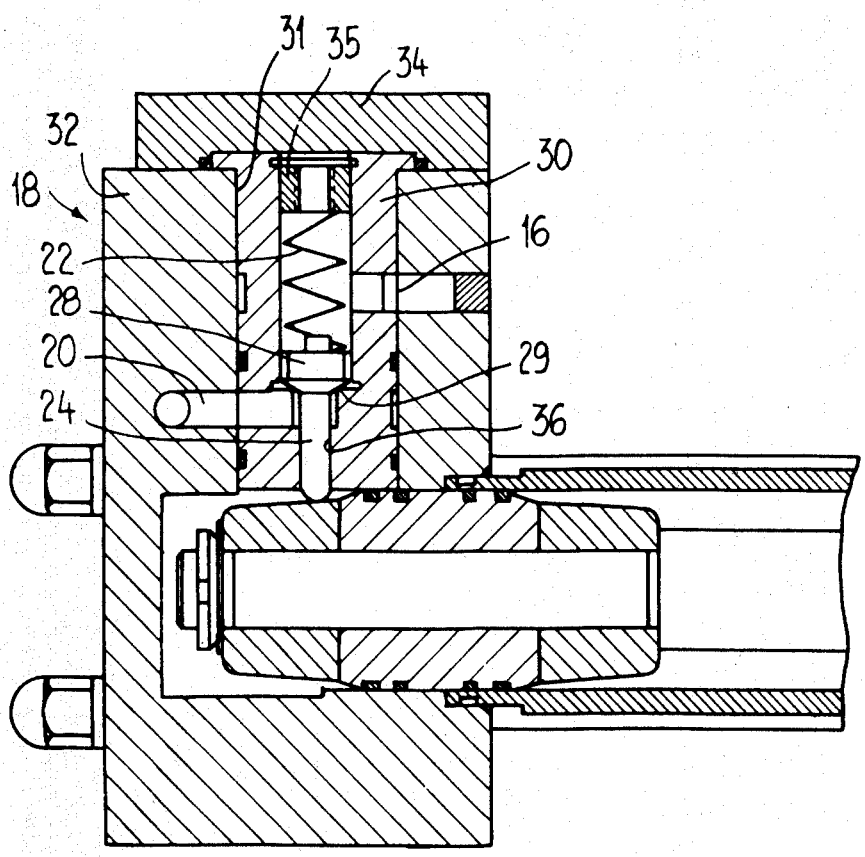
FIG. 3 illustrates a detail of FIG. 2, on an enlarged scale in relation to FIG. 2, during the reversing of the reciprocating piston.

The described mode of operation and especially the therewith associated advantages are particularly evident by referring to FIGS. 2 and 3. In these Figures — while taking into account the fact that they have been shown turned or flipped-over with respect to the showing of FIG. 1 — the same components have been generally designated by the same reference characters employed in FIG. 1. There will be clearly seen that the control surfaces 26 and 27 of the piston 25 are of substantially conical construction, and each of the plungers of the outlet valves (see for instance the plunger 24 of the valve 18 of FIG. 3) is gradually displaced back and the valve therefore gradually opens. In this regard it is to be appreciated that such is not dependent upon a certain terminal position of the piston, rather such is associated with a tolerance zone determined by or among other things determined by the conical control surfaces.

As best seen by referring to FIG. 3, wherein there are shown details of the outlet or discharge valve 18, and is to be understood the other valve 17 is essentially of the same construction, such valves each possess a valve body 28 rigidly connected with the associated plungers 24 and 23, respectively, and each such valve body under the action of the associated valve spring (designated by reference character 22 in FIG. 3) bears upon a valve seat 29. This valve seat 29 is formed in a hollow substantially cylindrical valve housing 30 which in turn is inserted into a radial bore 31 of a head piece 32 (FIG. 3) or 33 (FIG. 2) and at that location fixedly retained by means of a cover 34 threaded at the associated head piece. By means of radial bores of the valve housing or connection channels of the relevant head piece the outlet valves, as indicated in FIG. 3 with the corresponding reference characters, are connected on the one hand with the conduit 15 or 16, respectively, and, on the other hand, with the conduits 19 or 20 respectively. In this connection the valve bodies are subjected to a closing force which is a composite of the spring force and the pressure of the system. The valve springs 21, 22 are supported in each instance at a spring support 35 which is detachably secured at the outer end of the associated valve housing 30. At the other end of the valve housing 30 there is located an axial bore or guide 36 in which there is guided the associated plunger 23 or 24. With this arrangement the outlet or discharge valves 17 and 18 form cartridge-like inserts which are easily exchangeably housed in the head pieces of the cylinder, this being carried out without any impairment of the function. As a result there is realized a simple and compact construction with low fabrication costs and practically no maintenance costs, particularly since all movable parts or components are located in a closed space. Accordingly, there is realized a tendency of using such reciprocating drive particularly in conjunction with rough or heavy-duty conditions, such as for instance at building machines and so forth.

The described arrangement or corresponding arrangements are of course also usable in pneumatic or hybrid (mixed) installations. The identity of the actuation fluid medium (of the switching element) and the working fluid medium (of the reciprocating drive) in certain instances indeed is of advantage, however, is not an absolute necessity. In all instances the possible leakage losses within the control system are directly removed without further measures being undertaken.

Also, but not only, there are thus realized with such arrangement simple conduit networks and simple control elements, this being in comparison for instance to solutions in which there are required for solving the same functions multi-path valves and additionally also special damping measures.

Figure 4:
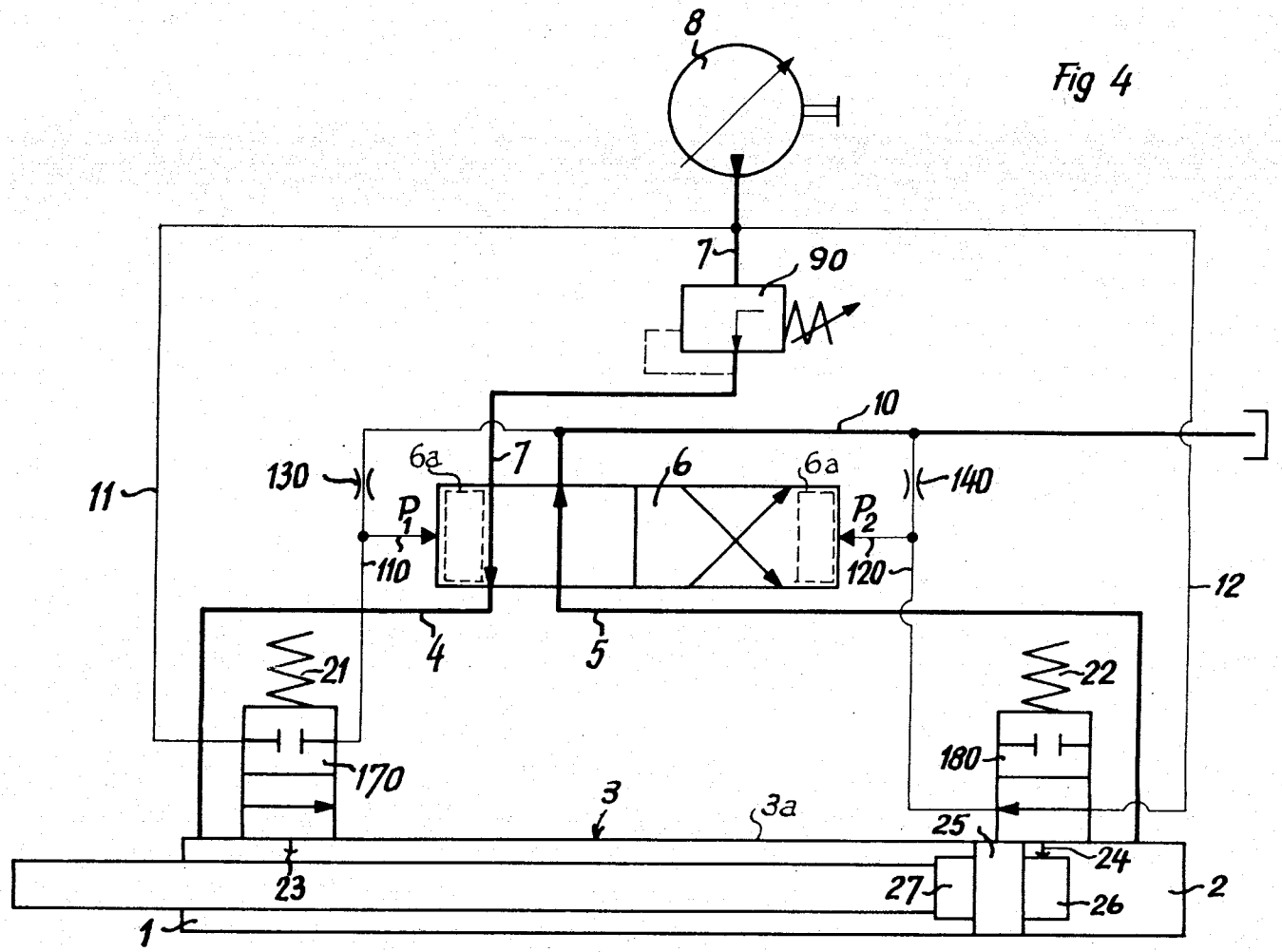
FIG. 4 illustrates a circuit diagram of a modified arrangement from that shown in FIG. 1.

What has been discussed above is analogously applicable for the exemplary embodiment depicted in FIG. 4, in which the same or corresponding components have been designated with the same or with a modified reference character. In order to prevent repetition of the description this embodiment only will be described to the extent that it differs from the embodiment shown in FIG. 1.

With this variant embodiment the infeed line or conduit 7 of the displacement valve or valve unit 6 is connected via a pressure reduction valve 90 with the pressure oil pump 8, valve 90 replacing the pressure regulating valve 9 of FIG. 1. The actuation lines 11 and 12 with this embodiment lead directly to the inlet of the shutoff valves 170 and 180, respectively, and then via the actuation conduits 110 and 120, respectively. from the outlets of such shutoff valves 170 and 180, respectively, to the corresponding actuation element (*cf* compare arrows $P_1$ and $P_2$ respectively). Corresponding to their function in this circuit arrangement, the shutoff valves 170 and 180 shall be hereinafter referred to as inlet valves. The throttle locations or throttles 130 and 140 respectively in this case, viewed in the direction of flow, are provided downstream of or behind the inlet valves 170 and 180 respectively, whereby such are connected at the outlet side with the return flow line or conduit 10, as shown.

Now if in the corresponding terminal position of the piston 25 one of the inlet valves 170 or 180 is opened (according to the showing of FIG. 4 this is so for the valve 180), then the actuation conduit or line 110 or 120, respectively, receives pressurized oil, whereby the throttle location 130 or 140, respectively, brings about a pressure increase which is sufficient for the switching or reversal of the displacement valve 6. As soon as this situation is present then the piston 25 is switched or reversed and the relevant inlet valve 170 or 180 is closed, leading to the relief of the actuation line 110 or 120, activated via the relevant valve, by means of the throttle location 130 or 140 respectively. These throttle locations are designed such that during the reversal there cannot occur any or any appreciable pressure drop in the system.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. An apparatus for the control of a fluid medium, comprising a double-acting reciprocating piston, a cylinder for housing said piston, a switching element actuated by a pressurized fluid medium, pressure source means for supplying pressurized fluid medium to the switching element, a pair of actuation elements working in opposed relationship to one another, said switching element being reversible between two switching positions by means of said two actuation elements, an actuation line provided for each actuation element for connecting the pressure source with each such actuation element, a respective normally closed shutoff valve having an inlet side and an outlet side for admitting pressurized fluid from the pressurized source means to the actuation line of each actuation element, said shutoff valves having only two positions defining an open position communicating said inlet and outlet sides and a normally closed position blocking flow between said inlet and outlet sides, means normally closing the shutoff valves, a respective throttle means provided for each actuation element and shutoff valve and connected with the outlet side of its associated shutoff valve for increasing the pressure in the actuation line to thereby operate its associated actuation element, each said actuation element being directly connected to its associated actuation line between the outlet side of its associated shutoff valve and its associated throttle means, the inlet side of each shutoff valve being directly connected to the pressure source, said shutoff valves being arranged respectively at the region of the end positions of the stroke of the reciprocating piston, each shutoff valve having a respective plunger laterally extending into the cylinder and cooperating with a control surface of said reciprocating piston for operating said shutoff valve.

2. The apparatus as defined in claim 1, wherein the shutoff valves are arranged in respective head pieces of the cylinder.

3. The apparatus as defined in claim 2, wherein each of the shutoff valves each possess a substantially hollow cylindrical valve housing having bore means at one end of which there is formed a valve seat for a valve body and at the other end of which there is attached a spring support for a spring bearing at the other end of the valve body, the valve housing being inserted into a radial bore of the associated head piece and the associated plunger extending through an axial guide bore of the valve housing.

4. The apparatus as defined in claim 1, wherein the means normally closing each of the shutoff valves comprises a spring.

5. The apparatus as defined in claim 1, wherein the means normally closing each of the shutoff valves is a pressurized fluid medium.

6. The apparatus as defined in claim 1, wherein the means normally closing each of the shutoff valves comprises a force selectively exerted by at least one of a spring and a pressurized fluid medium.

7. The apparatus as defined in claim 1, wherein said control surface widens toward the center of said reciprocating piston.

* * * * *